United States Patent [19]

Morrison

[11] Patent Number: 4,507,913

[45] Date of Patent: Apr. 2, 1985

[54] VACUUM SPINNING

[75] Inventor: Elbert F. Morrison, Clarksville, Va.

[73] Assignee: Burlington Industries, Inc., Greensboro, N.C.

[21] Appl. No.: 386,078

[22] Filed: Jun. 7, 1982

[51] Int. Cl.[3] ..... D01H 5/28; D01H 1/12; D01H 1/13; D02G 1/04

[52] U.S. Cl. ..... 57/328; 57/5; 57/204; 57/224; 57/334; 57/341; 57/401; 57/403

[58] Field of Search ..... 57/400-403, 57/204, 328, 210, 224, 334, 409, 341-344, 5, 6; 415/203; 239/240; 34/135-137, 156

[56] References Cited

U.S. PATENT DOCUMENTS

| | | | |
|---|---|---|---|
| 2,020,960 | 11/1935 | Pehrson et al. | 34/135 |
| 2,239,722 | 4/1941 | Lannan et al. | 57/343 X |
| 2,809,024 | 10/1957 | Simon et al. | 34/137 X |
| 3,079,746 | 3/1963 | Field, Jr. | 57/328 |
| 3,365,872 | 1/1968 | Field, Jr. | 57/328 X |
| 3,707,838 | 1/1973 | Dorschner et al. | 264/103 X |
| 3,757,507 | 9/1973 | Maxham | 57/409 X |
| 3,802,174 | 4/1974 | Landwehrkamp et al. | 57/5 |
| 3,913,310 | 10/1975 | Fehrer | 57/401 |
| 3,978,648 | 9/1976 | Yamagata et al. | 57/5 |
| 3,996,731 | 12/1976 | Koella | 19/105 X |
| 4,003,194 | 1/1977 | Yamagata et al. | 57/328 |
| 4,070,812 | 1/1978 | Ostrowski et al. | 57/403 |
| 4,073,128 | 2/1978 | Ostrowski et al. | 57/403 |
| 4,073,129 | 2/1978 | Ostrowski et al. | 57/403 |
| 4,109,454 | 8/1978 | Fehrer et al. | 57/401 |
| 4,183,202 | 1/1980 | Morihashi | 57/328 |
| 4,207,728 | 6/1980 | Ostrowski et al. | 57/403 |
| 4,249,368 | 2/1981 | Fehrer | 57/5 |
| 4,265,082 | 5/1981 | Sasaki et al. | 57/328 X |
| 4,322,944 | 4/1982 | Sraitr et al. | 57/328 |

FOREIGN PATENT DOCUMENTS 880239 10/1961 United Kingdom .

*Primary Examiner*—John Petrakes

*Attorney, Agent, or Firm*—Cushman, Darby & Cushman

[57] ABSTRACT

An unusual spun yarn is produced by feeding fibers or a sliver or roving into the interior of a hollow shaft. The shaft includes a perforated portion, and a vacuum is applied at the exterior of the shaft. The shaft is mounted for free rotation about an axis coincident with the direction of movement of the fibers through the shaft, and blades extend radially from the perforated portion of the shaft. When the rotates at high velocity under the influence of the vacuum it produces the unusual spun yarns.

16 Claims, 7 Drawing Figures

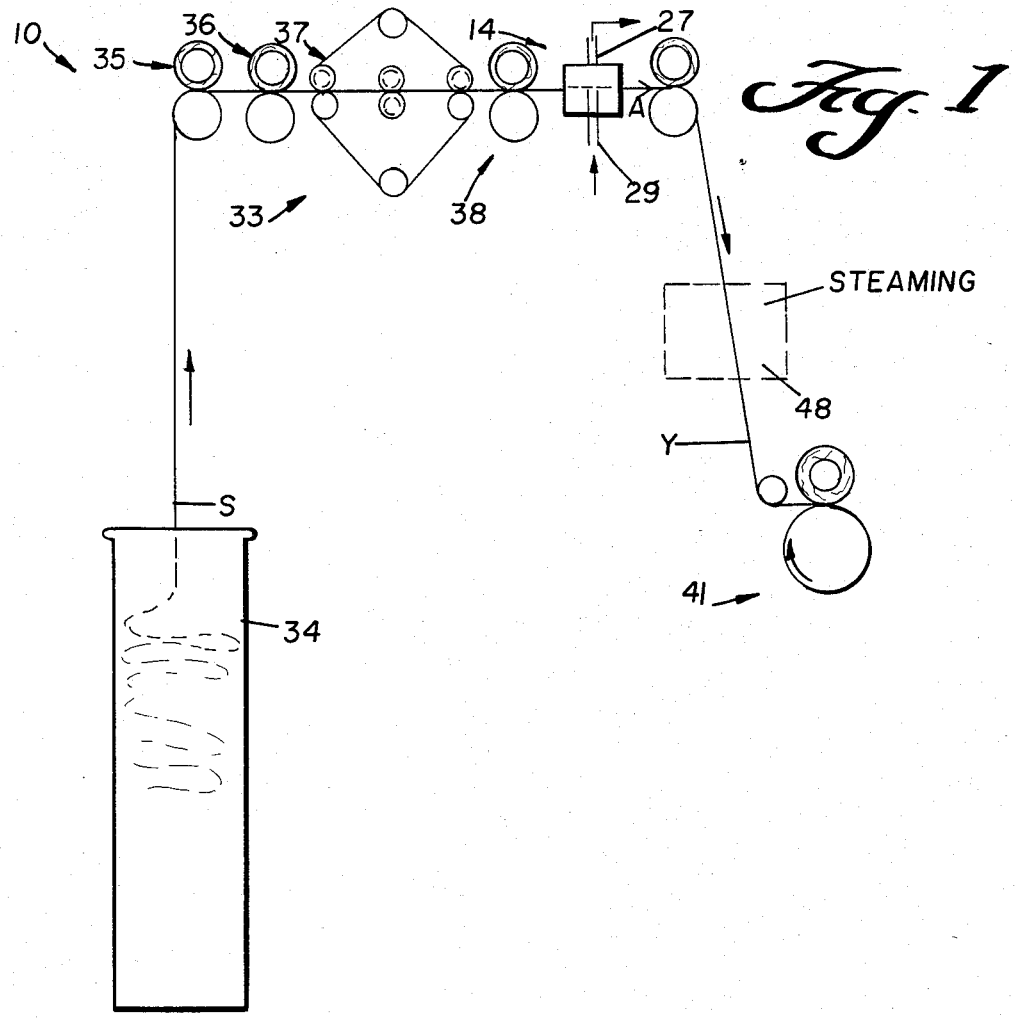
Fig. 1
Fig. 2
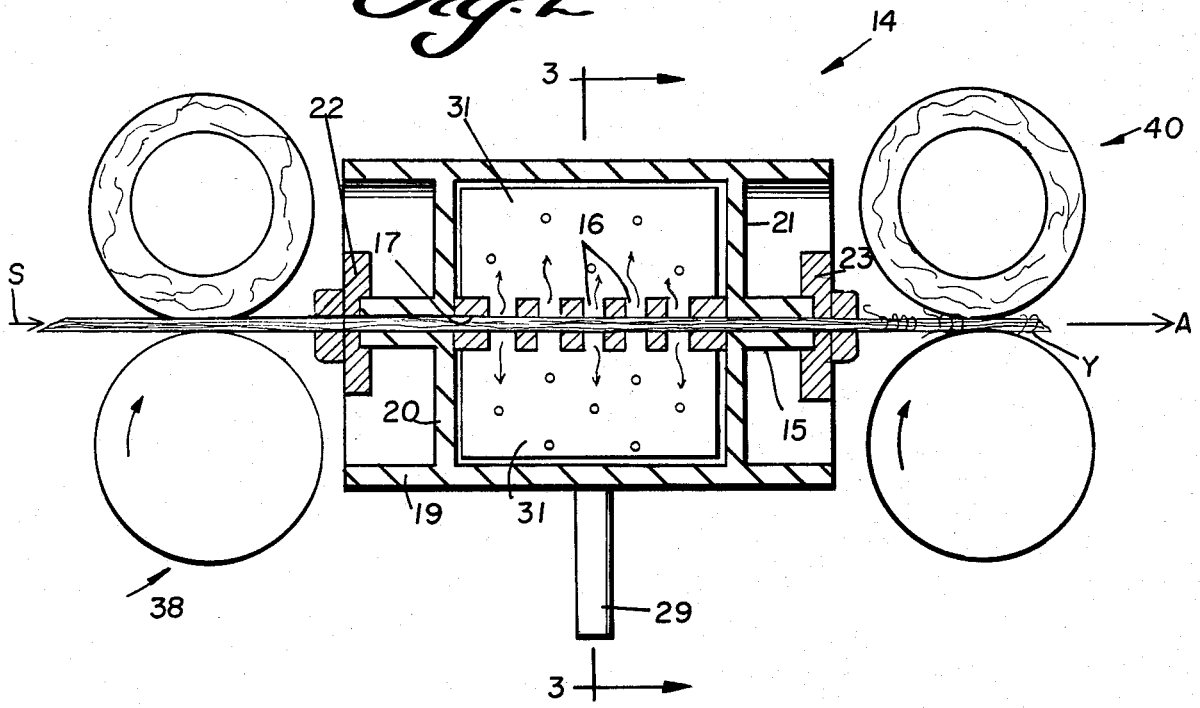

65
64
Y'
VACUUM SOURCE
28
A
38
12
14
27
29
19
57
62
59
50
53
51
52
60
58
S
34

VACUUM SPINNING

BACKGROUND AND SUMMARY OF THE INVENTION

Conventional spun yarns are normally made by ring spinning or open-end spinning. While such methods produce good quality yarn, there are certain restrictions and complications associated therewith. For instance open-end spinning systems have rather restrictive limitations as to staple length, rotor speeds, twist directions, wrapper fibers, fibers per cross-sectional area, and fiber bending modulus, stiffness, and other properties. According to the present invention, an apparatus and method are provided which seek to eliminate a number of the restrictions associated with open-end spinning, and in general to provide for the production of spun yarn in a simple, uncomplicated manner. The yarns produced according to the present invention have somewhat different appearance and construction characteristics than conventional spun yarns, but definitely have a spun appearance.

The basic apparatus according to the present invention comprises a hollow shaft with at least a portion of the entire circumference thereof being perforated, and mounted for rotation about an axis coincident with the direction of movement of fibers being spun into yarn. The fibers are fed into a first end of the hollow shaft, and the produced yarn is withdrawn from the second end of the hollow shaft. The shaft is caused to rotate at high speed, and a vacuum is applied to the exterior of the shaft to supply an attractive force to the free ends of the fibers interior of the shaft. Both these functions are accomplished by disposing the perforated portion of the shaft in a housing, attaching a plurality of radially-extending vanes to the perforated portion of the shaft, connecting one portion of the housing interior to a vacuum source, and connecting an opposite portion of the housing interior to a source of ambient air (or other gas). The vacuum sucks ambient air through the housing interior, the air acting upon the vanes to effect high speed rotation of the shaft, and at the same time the vacuum acts upon the interior of the shaft, imparting rotation to fibers within the shaft.

The apparatus according to the invention may be fed by either free fibers, to produce an open-end type spun yarn, or may be fed by fibers in a sliver or roving fiber mass.

To produce an open-end type yarn according to the invention, a sliver or roving is passed to a combing roll assembly, and the free fibers produced—which have a staple length of about 1 inch to 6 inches—are passed to a collector roll assembly. The collector roll is grooved, and has means defining perforation in its groove. A portion of these perforations (e.g. about $\frac{3}{8}$ of the groove circumference) are connected up to a source of vacuum, fibers being aligned therewith and passed to the first end of the rotating perforated shaft. Delivery rolls, with the nip therebetween in-line with the shaft axis, withdraw the formed yarn from the shaft second end, and the yarn is taken up on a take-up roll. The fibers when introduced into the shaft are attracted to the shaft interior and rotate with the shaft while moving linearly along the shaft axis. The shaft rotation fully controls the fibers interengagement.

Spun-type yarn produced according to the present invention may be produced from a wide variety of types of fibers, such as cotton, polyester, rayon, acrylic, wool, mohair, etc., the spinning process not being as dependent upon bending modulus or stiffness of the composite fibers as is conventional open-end spinning. According to the invention, open-end type spun yarn can be formed with fewer fibers per cross-sectional area, and the yarn will have real twist, either "Z" or "S" direction twist. Restrictions on the end use of open-end type spun yarn according to the invention would not be comparable to conventional open-end spun yarns, but rather would be more comparable to conventional ring spun yarns.

According to another aspect of the invention, yarn produced from sliver or rovings that are fed to the vacuum spinning apparatus according to the present invention has unusual characteristics compared to conventional ring-spun yarn. The sliver or roving is fed to a draft system, wherein approximately 40–60% of the fibers within the sliver or roving mass are nipped so that these fibers are held tight. The remaining 60–40% of the fibers have loose ends, and of this group approximately 10–15% are loose on the surface of the fiber mass. When the fiber mass is fed into the rotating perforated tube, free ends of the fibers are attracted to the tube surface and rotate with the tube, being held substantially linearly stationary while the fiber mass is linearly moving along the axis of rotation of the tube. With rotation of the perforated shaft at least about 18 revolutions per inch of sheath fibers drawn through the shaft (e.g. 18–30 revolutions per inch), the free fiber ends are wrapped around the fiber mass and hold it tightly.

The end yarn produced according to the immediately-above described method has some fibers wrapped around the fiber mass in a linear direction, while others show a reverse fold wrap, and have a unique construction and appearance.

It is the primary object of the present invention to provide for the simple, effective production of spun yarn. This and other objects of the invention will become clear from an inspection of the detailed description of the invention, and from the appended claims.

BRIEF DESCRIPTION OF THE DRAWINGS

FIG. 1 is a side schematic view of an exemplary system for producing vacuum-spun yarn according to the present invention;

FIG. 2 is a side detail cross-sectional view of an exemplary vacuum spinning device according to the invention, the cross-section being taken along lines 2—2 of FIG. 3;

DETAILED DESCRIPTION OF THE DRAWINGS

Figure 6:
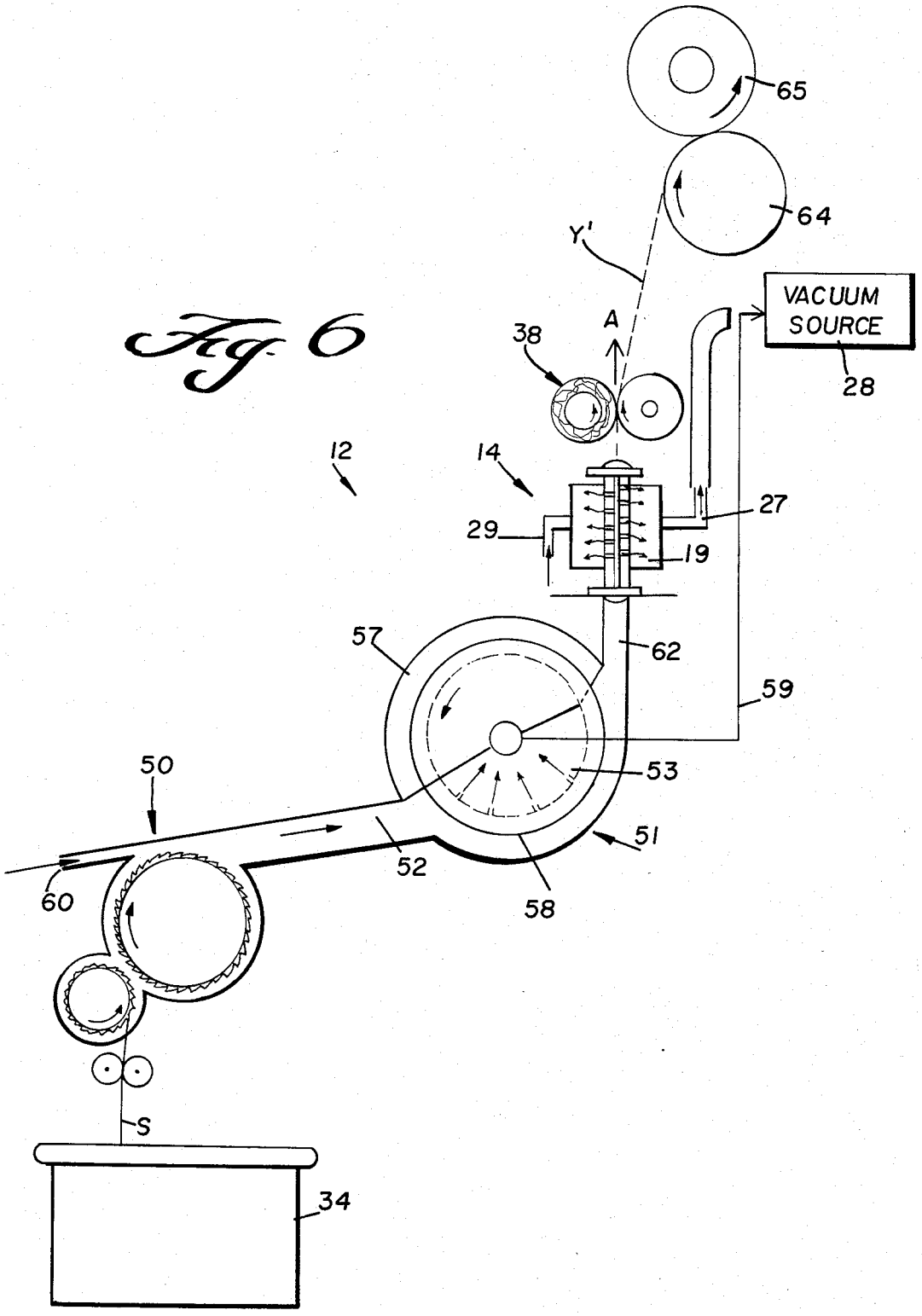
FIG. 6 is a side schematic showing of exemplary apparatus for producing an open-end type vacuum spun yarn according to the invention.

Two different embodiments of apparatus for producing vacuum spun yarn according to the present invention are illustrated in FIGS. 1 and 6, by general reference numerals 10 and 12, respectively. The apparatus 10 produces a yarn similar to conventional ring-spun yarn, while the apparatus 12 produces an open-end type spun yarn, which yarn—however—has properties similar to both conventional ring-spun and open-end spun yarns. A major component of each of the systems 10, 12 is the vacuum spinning apparatus 14, which is shown most clearly in FIGS. 2 and 3.

The apparatus 14 comprises as the main component thereof a hollow shaft 15. At least a portion of the entire circumference of the hollow shaft 15 is perforated. Preferably the central portion of the shaft has perforations 16 formed therein. The shaft is mounted for rotation about an axis, that axis being coincident with the linear direction of feed A of fibers to be produced into yarn. The shaft should be dimensioned so that it allows the fibers to pass therethrough, and allows enough air to be drawn through with the fibers to allow proper vacuum-attraction of fibers to the interior surface 17 thereof.

The shaft 15 perforated central portion is encompassed by a housing 19. Rotation of the shaft about its axis may be provided by bearings associated with housing end walls 20, 21, and/or further bearings 22, 23 receiving the ends of shaft 15 extending outwardly from the end walls 20, 21. The shaft 15 is mounted for free rotation.

A vacuum is applied to the housing 19 interior, to an exterior portion of the shaft 15, so as to act upon yarn fibers within the hollow interior of the shaft 15. This is preferably accomplished by providing a vacuum conduit 27 in operative communication with one portion of the housing 19 interior, and is connected up to a conventional vacuum source 28, such as a vacuum pump. Connected to the interior of the housing opposite the conduit 27 (i.e. on the opposite side of shaft 15) is a conduit 29 which is in operative communication with the ambient air, or other source of supply of gas.

Connected to the shaft (preferably integral therewith) are a plurality of radially extending vanes 31. These vanes 31 extend to a radial point just short of the interior surface of the housing 19. When a vacuum is applied to conduit 27, air is drawn through conduit 29, acts upon the vanes 31 effecting rotation of the shaft 15, and is withdrawn through conduit 27. While this is taking place, air is also being withdrawn from the interior of shaft 15, and fibers are being attracted to the interior surface 17 of shaft 15. For the arrangement illustrated in FIG. 3, rotation is in the direction of arrows B, however the structure could be arranged so that rotation were in the opposite direction.

The apparatus 14 provides a simple, effective structure for producing spun yarn. It is simple and easy to maintain, may be easily rotated at high speed, and may be formed of lightweight, durable materials.

Associated with the vacuum spinning device 14 and the apparatus 10 is a draft system, generally indicated by reference numeral 33 in FIG. 1. A sliver or roving S from a bin 34 is drawn by feed roll sets 35, 36, 37, and passed through the nip of front feed roll set 38. The nip of the front feed roll set 38 is in-line with the axis of rotation of shaft 15. The draft system 33 acts upon the fibers of the sliver or roving S so that approximately 40–60% of the fibers within the mass are nipped and held tight. The remaining 60–40% of the fibers have loose ends, and approximately 10–15% of this group are loose on the surface of the fiber mass.

A set of delivery rolls 40 is mounted on the opposite side of apparatus 14 as the draft system 33, the nip of the roller set 40 also being in alignment with the axis of rotation of shaft 15. The delivery roll set 40 draws the formed yarn Y out from the apparatus 14, and eventually the yarn Y is taken up on conventional take-up roller means 41.

When the fibers are passed into the hollow interior of the shaft 15, free ends of the fibers are attracted to the interior surface 17 by the vacuum while the basic fiber mass is being transported in the linear direction A. Fiber ends attracted to the interior surface 17 are held substantially linearly stationary while they rotate with the shaft 15, and thus such fibers become wrapped around the main fiber mass. The shaft 15 is rotated at least 18 revolutions (e.g. 18–30 revolutions) per inch of the main fiber mass (sheath fibers) drawn through the shaft in order to provide sufficient wrapping to provide the desired strength to the yarn Y produced.

Figure 3:
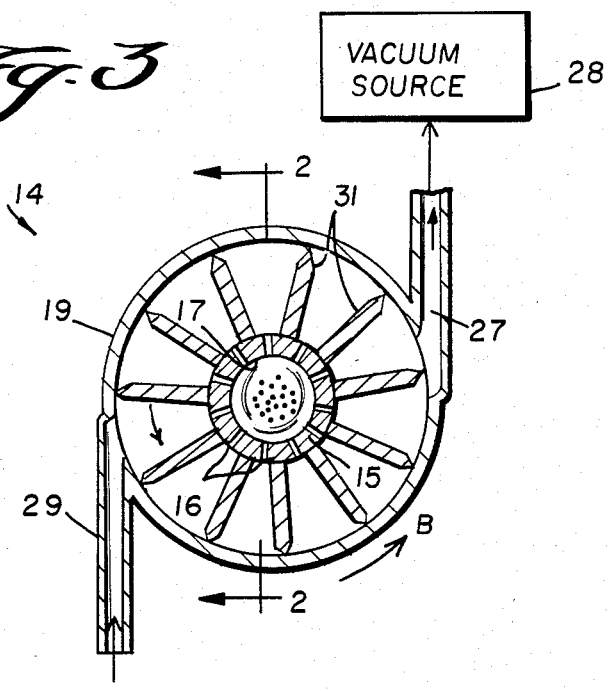
FIG. 3 is another cross-sectional view of the apparatus of FIG. 2, taken along lines 3—3 thereof.
Figure 4:
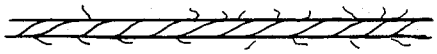
Fig. 4 PRIOR ART
FIG. 4 schematically illustrates a conventional ring-spun yarn construction, while FIG. 5 schematically illustrates a construction of a yarn produced utilizing the apparatus of FIG. 1.
Figure 5:
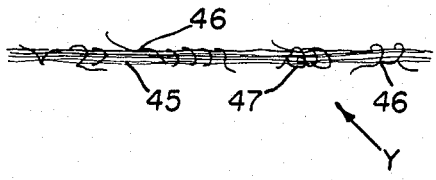

Yarn Y produced according to the invention of FIGS. 1 through 3 is illustrated schematically in FIG. 5. This yarn Y can be compared to conventional ring-spun yarn illustrated in FIG. 4, the yarn of FIG. 4 having a beardy look with actual full diameter twists around the yarn. Yarn Y according to the invention, however, includes a central mass 45 with some fibers 46 wrapped therearound in a linear direction, while other fibers 47 have a reverse fold wrap.

If necessary, the yarn Y may be steamed in order to better secure and set the wrapped fibers 46, 47. This may be accomplished by passing it through a conventional steaming apparatus 48 prior to being taken up by rollers 41, or steaming may be practiced as an entirely different step after take up.

Figure 7:
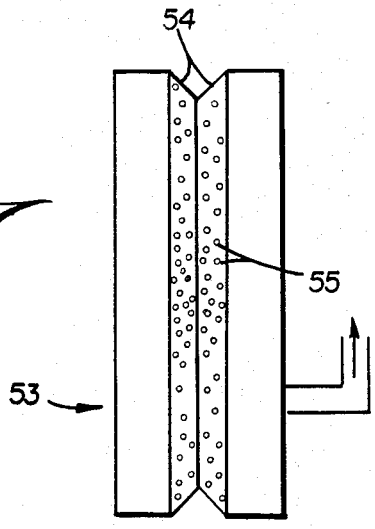
FIG. 7 is an end view of the collector roll of the apparatus of FIG. 6.

The apparatus 12 of FIG. 6 includes, in place of the draft system 33 of apparatus 10, a conventional combing roll assembly 50, and a collector roll assembly 51. The combing roll assembly 50 forms individual fibers from the sliver or roving S, and passes them through air throat 52 to the collector roll assembly 51. The collector roll 53 of the collector roll assembly 51 is illustrated more clearly in FIG. 7, and includes means defining a groove 54 therein. Also, means are provided defining a plurality of perforations 55 in the groove 54. The collector roll assembly 51 includes a housing portion 57 in which no vacuum is applied, and another portion 58 in which vacuum is applied from source 28 so that air is pulled from the exterior of the roller 53 through perforations 55 to the interior of the roller 53, ultimately being passed through conduit 59 to vacuum source 28.

The fibers in throat 52 are entrained in a balanced air flow, air entering air intake 60, and also being pulled through collector roller 53 and perforations 55 by the vacuum source 28, so that the fibers in air throat 52 are generally parallel. Typical staple length would be 1–6 inches. The fibers collect on roll 53 side-by-side, and build up in fiber layers depending upon the speed of roll 53. Approximately $\frac{3}{8}$ of the roll 53 is subjected to the vacuum source 28, while the other $\frac{5}{8}$ is not. The fibers are released by the roll 53 on the upside of roller assembly 51 into air throat 62, under the influence of the vacuum applied to the interior of the housing 19 of the vacuum spinning device 14.

When the mass of free fibers pass through air throat 62 into the hollow interior of shaft 15, they are attracted to the interior surface 17 of shaft 15, and rotate therewith as they are being conveyed in the direction A. This rotation fully controls the fibers, so they do not have the same type of entanglement that is present in conventional open-end spinning processes. The fiber mass has real twist, which may be in either the "Z" direction or the "S" direction.

The yarn Y' withdrawn from apparatus 14 by delivery rolls 38 is taken up by a conventional dog or grooved type take-up roll 64, onto a package 65. The yarn Y' may be formed from a wide variety of fibers, bending modulus, stiffness, and other properties of the fiber type not being as critical as in conventional open-end spinning; and the yarn Y' may be spun with fewer fibers per cross-sectional area.

It will thus be seen that according to the present invention an apparatus and method for providing simple and effective spinning of yarn has been provided. The apparatus according to the invention is capable of producing unique types of yarn, both from nipped slivers or rovings, or from open-end fibers.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, apparatus, and products.

What is claimed is:

1. Apparatus for forming yarn, comprising:

a hollow shaft, at least a portion of the entire circumference of which is perforated;

means for mounting said shaft for rotation about an axis;

means for rotating said shaft about its axis;

means for passing textile fibers through the interior of said shaft linearly, generally along the axis of rotation thereof, the fibers being fed into a first end thereof;

means for applying a vacuum to the exterior of said shaft so that at least some of the fibers or free ends of fibers passing through said shaft will draw toward the shaft perforations, and will be caused to rotate with said shaft as said fibers move linearly generally along the axis of rotation; and means for withdrawing formed yarn from a second end of said shaft, opposite said first end thereof.

2. An apparatus as recited in claim 1 wherein said means for passing textile fibers into a first end of said shaft comprise means for passing a sliver or roving into said shaft first end.

3. Apparatus as recited in claim 1 wherein said means for passing textile fibers into a first end of said shaft comprises means for passing open-end fibers into said shaft.

4. Apparatus as recited in claims 1, 2 or 3 wherein said means for rotating said shaft about its axis comprises; a plurality of radially extending blades attached to said shaft perforated portion; a housing containing said blades and shaft perforated portion; said means for applying a vacuum to the exterior of said shaft applying a vacuum to the interior of said housing; and means for providing the entry of ambient air to said housing under the influence of said means for applying a vacuum, the air acting on said blades and effecting rotation of said shaft.

5. Apparatus as recited in claim 3 wherein said means for passing textile fibers through said shaft include a combing roll assembly, means for feeding a sliver or roving to said combing roll assembly, and a collector roll assembly for collecting fibers produced by said combing roll assembly.

6. Apparatus as recited in claim 5 wherein said collector roll assembly comprises a grooved roller, the portions thereof defining the groove being perforated, and means for connecting said perforations up to a vacuum.

7. Textile apparatus comprising: a housing; a hollow shaft, at least an entire circumferential portion of which is perforated; means for mounting said shaft for free rotation, about an axis, with respect to said housing, with said perforated portion thereof interior of said housing; a plurality of blades affixed to said shaft and extending radially outwardly therefrom, and located interior of said housing; means for applying a vacuum to a first portion of said housing interior; and means for connecting a second portion of said housing interior, remote from said first portion, to a supply of gas.

8. Apparatus as recited in claim 7 further comprising a pair of delivery rolls, and means for mounting said delivery rolls so that the nip therebetween is disposed immediately exterior of one end of said hollow shaft, and in alignment with said axis of rotation.

9. Apparatus as recited in claim 8 further comprising a draft system mounted on the opposite side of said shaft as said delivery rolls, and operatively in-line with said axis of rotation.

10. Apparatus as recited in claim 8 further comprising a combing roll assembly and a collector roll mounted on the opposite side of said housing as said delivery rolls, said collector roll being operatively in-line with said axis of rotation.

11. Apparatus as recited in claim 10 wherein said collector roll comprises means defining a central groove, and perforations in said central groove; and further comprising means for connecting the perforations in a portion of the circumference of said collector roll to a source of vacuum.

12. A method of spinning yarn comprising the steps of:

feeding a plurality of free fibers having a staple length of about one inch to 6 inches in a linear direction A, in a fiber mass;

passing the fiber mass into the interior of a hollow shaft rotatable about an axis generally coincident with the direction A, the shaft having perforations along the entire circumference of at least a portion thereof;

applying a vacuum to the exterior of the perforated portion of the shaft circumference sufficient to attract the fiber mass inside the shaft toward the shaft interior surface; and rotating the shaft at high speed so that the fibers interior of the shaft rotate with the shaft as they are moving in the direction A, the rotation fully controlling fiber interengagement to produce a final yarn.

13. A method of spinning yarn utilizing a hollow shaft having at least a portion of an entire circumferential surface thereof with perforations, and mounted for rotation about an axis substantially coincident with a linear direction A; comprising steps of:

nipping a sliver or roving so that some of the fibers within the sliver or roving mass are tight, forming a fiber sheath, with the remaining fibers having loose ends;

transporting said nipped sliver or roving in a linear direction A at a substantially constant linear speed; and while transporting the sliver or roving mass in direction A, rotating loose ends of fibers around the fiber mass, the ends being held substantially linearly stationary during rotation, to wrap the fiber ends around the moving fiber mass to produce the desired yarn, said rotating step being accomplished by: feeding the fiber sheath into the interior of the hollow shaft at one end thereof; applying a vacuum to the exterior of said hollow shaft perforated portion to cause free ends of fibers within the hollow shaft to be drawn toward the interior surface of said hollow shaft; and rotating said hollow shaft so that free ends moving towards the interior surface of said hollow shaft will be generally rotated therewith.

14. A method as recited in claim 13 wherein said nipping step is practiced so that approximately 40–60 percent of the fibers within the sliver or roving mass are tight, while the remaining 60–40 percent of the fibers have loose ends.

15. A method as recited in claim 13 wherein said shaft rotating step is practiced by rotating the shaft at sufficient rpm per inch of sheath drawn through the shaft in order to provide sufficient wrapping and the desired strength of the yarn produced.

16. A method as recited in claim 13 wherein said rotating step is practiced so that some fibers are wrapped in a linear direction around the fiber mass, while others show a reverse fold wrap.

* * * * *